US010448747B2

(12) United States Patent
Totemeier et al.

(10) Patent No.: US 10,448,747 B2
(45) Date of Patent: Oct. 22, 2019

(54) ARTICULATING BED STRUCTURE WITH NARROW FRAME FOR DISSASEMBLY

(71) Applicant: Ergomotion, Inc., Goleta, CA (US)

(72) Inventors: Hunter Davis Totemeier, Santa Barabara, CA (US); Joseph Ermalovich, Santa Barbara, CA (US)

(73) Assignee: ergomotion, inc., Goleta, CA (US)

( * ) Notice: Subject to any disclaimer, the term of this patent is extended or adjusted under 35 U.S.C. 154(b) by 315 days.

(21) Appl. No.: 15/611,548

(22) Filed: Jun. 1, 2017

(65) Prior Publication Data

US 2017/0347807 A1 Dec. 7, 2017

Related U.S. Application Data

(60) Provisional application No. 62/344,773, filed on Jun. 2, 2016.

(51) Int. Cl.

| | |
|---|---|
| ***A47C 20/04*** | (2006.01) |
| ***A47C 19/02*** | (2006.01) |
| ***A47C 19/00*** | (2006.01) |
| ***A61G 7/015*** | (2006.01) |
| ***A61G 13/08*** | (2006.01) |

(52) U.S. Cl.

CPC ..... *A47C 20/041* (2013.01); *A47C 19/005* (2013.01); *A47C 19/021* (2013.01); *A61G 7/015* (2013.01); *A61G 13/08* (2013.01)

(58) Field of Classification Search

CPC ..... A61G 7/002; A61G 7/005; A61G 7/012; A61G 7/015; A61G 7/018; A61G 13/02; A61G 13/04; A61G 13/06; A61G 13/08; A47C 20/04; A47C 20/041; A47C 20/08; A47C 19/00; A47C 19/005; A47C 19/02; A47C 19/021; A47C 19/025; A47C 19/04; A47C 19/045; A47C 19/12; A47C 19/122

USPC ..... 5/613, 616–618, 610, 620, 174, 200.1, 5/201, 202

See application file for complete search history.

(56) References Cited

U.S. PATENT DOCUMENTS 6,006,379 A * 12/1999 Hensley ..... A47C 20/041 5/616

6,209,157 B1 * 4/2001 Hensley ..... A47C 20/041 5/613

(Continued)

*Primary Examiner* — Robert G Santos

(74) *Attorney, Agent, or Firm* — Felix L. Fischer

(57) ABSTRACT

An articulating bed incorporates a frame having side frame members with a first fixed channel extending laterally between the frame side members and a second fixed channel extending laterally between the frame side members. A first rotatable channel open toward a head of the bed is engaged to the first fixed channel with first hinges. An upper body support panel is removably engaged in the first rotatable channel and an upper body panel support frame extends from the first rotatable channel coplanar with a lower flange to support the upper body panel. A second rotatable channel open toward the foot of the bed is engaged to the second fixed channel with second hinges. A thigh support panel is removably engaged in the second rotatable channel and a thigh panel support frame extends from the second rotatable channel coplanar with a lower flange of the second rotatable channel to support the thigh panel. A seat panel is removably engaged between the first fixed channel and second fixed channel.

15 Claims, 11 Drawing Sheets

(56) References Cited

U.S. PATENT DOCUMENTS

| | | | | |
|---|---|---|---|---|
| 6,357,065 | B1 * | 3/2002 | Adams | A47C 19/04 5/611 |
| 6,393,641 | B1 * | 5/2002 | Hensley | A47C 20/041 5/613 |
| 6,708,358 | B2 * | 3/2004 | Hensley | A47C 20/041 5/613 |
| 7,165,277 | B2 * | 1/2007 | Taguchi | A61G 7/015 5/617 |
| 7,690,060 | B2 * | 4/2010 | Rodrigues Moreira | A47C 20/04 5/613 |
| 7,930,780 | B2 * | 4/2011 | Clenet | A47C 20/041 5/618 |
| 9,049,942 | B2 * | 6/2015 | Huang | A47C 20/041 |
| 2001/0000828 | A1 * | 5/2001 | Hensley | A47C 20/041 5/618 |
| 2005/0076440 | A1 * | 4/2005 | Taguchi | A61G 7/015 5/618 |
| 2008/0000027 | A1 * | 1/2008 | Clenet | A47C 20/041 5/618 |
| 2008/0028535 | A1 * | 2/2008 | Rodrigues Moreira | A47C 20/04 5/722 |
| 2008/0276373 | A1 * | 11/2008 | Clenet | A47C 20/041 5/618 |
| 2015/0121623 | A1 * | 5/2015 | Huang | A47C 20/041 5/616 |
| 2017/0347807 | A1 * | 12/2017 | Totemeier | A47C 19/021 |

* cited by examiner

ARTICULATING BED STRUCTURE WITH NARROW FRAME FOR DISSASEMBLY

REFERENCES TO RELATED APPLICATIONS

This application claims priority of U.S. provisional application Ser. No. 62/344,773 filed on Jun. 2, 2016 entitled ARTICULATING BED STRUCTURE WITH NARROW FRAME FOR DISASSEMBLY having a common assignee with the present application, the disclosure of which is incorporated herein by reference.

BACKGROUND

Field

This invention relates generally to the field of adjustable beds and more particularly to a structure for an articulating bed having an articulating structure supported by a frame having removable legs and actuators, and composite panels removably received in rotatable channels for rigid supports in the articulating structure.

Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping.

The mechanical structure and drive mechanisms for such articulating beds must be able to support the weight of both a mattress and the occupant. Due to the size, weight, fabrication materials and configuration of the mattress and supporting structure, maintaining rigidity in the system may also be challenging. Typical articulating beds provide an articulating assembly with an upper body positioning element and a thigh positioning element either individually active or with combined actuation. The articulating assembly is mounted to a frame.

Actuators for the articulating assembly are typically large requiring significant vertical dimensions within the frame of the bed for actuation leverage. Typically the frame itself has a deep vertical dimension to remove the actuators from view and provide rigid support for the articulating assembly The size and weight of the various structure impedes easy packaging and shipping of the bed and disassembly of the structural elements of the bed is impossible or cumbersome.

It is therefore desirable to provide an articulating bed having a frame and articulating structure with limited dimensions which are easily packaged and disassembly features for other structural elements to reduce size and weight.

SUMMARY

The embodiments disclosed herein overcome the shortcomings of the prior art by providing an articulating bed incorporating a frame having side frame members with a first fixed channel extending laterally between the frame side members and a second fixed channel extending laterally between the frame side members. A first rotatable channel open toward a head of the bed is engaged to the first fixed channel with first hinges. An upper body support panel is removably engaged in the first rotatable channel and an upper body panel support frame extends from the first rotatable channel coplanar with a lower flange to support the upper body panel. A second rotatable channel open toward the foot of the bed is engaged to the second fixed channel with second hinges. A thigh support panel is removably engaged in the second rotatable channel and a thigh panel support frame extends from the rotatable channel coplanar with a lower flange of the second rotatable channel to support the thigh panel. A seat panel is removably engaged between the first fixed channel and second fixed channel.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1:
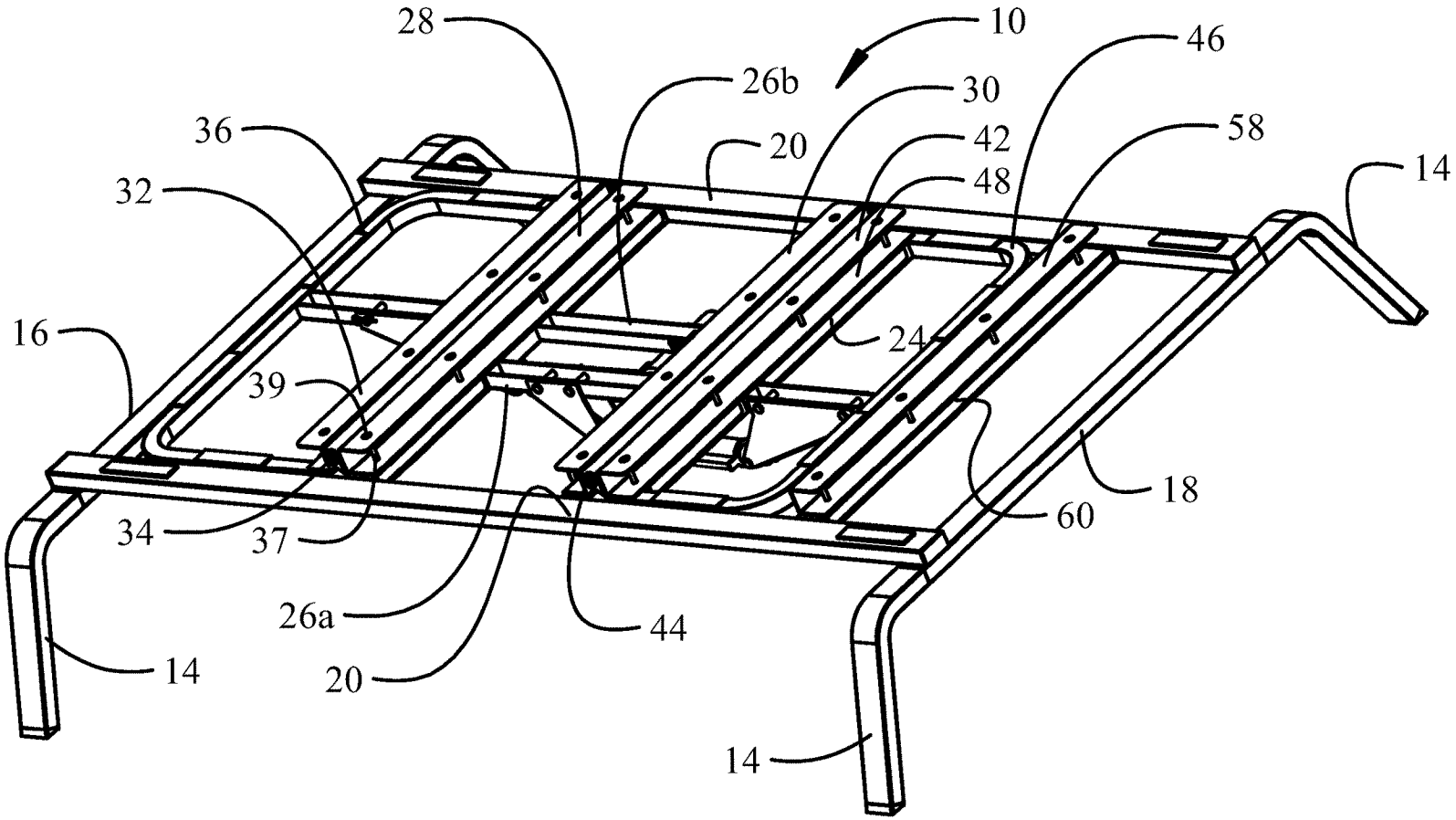
FIG. 1 is an upper pictorial representation of an embodiment of the adjustable bed system with the panel elements for the rigid supports removed and the articulating assembly in an unarticulated position.
Figure 2:
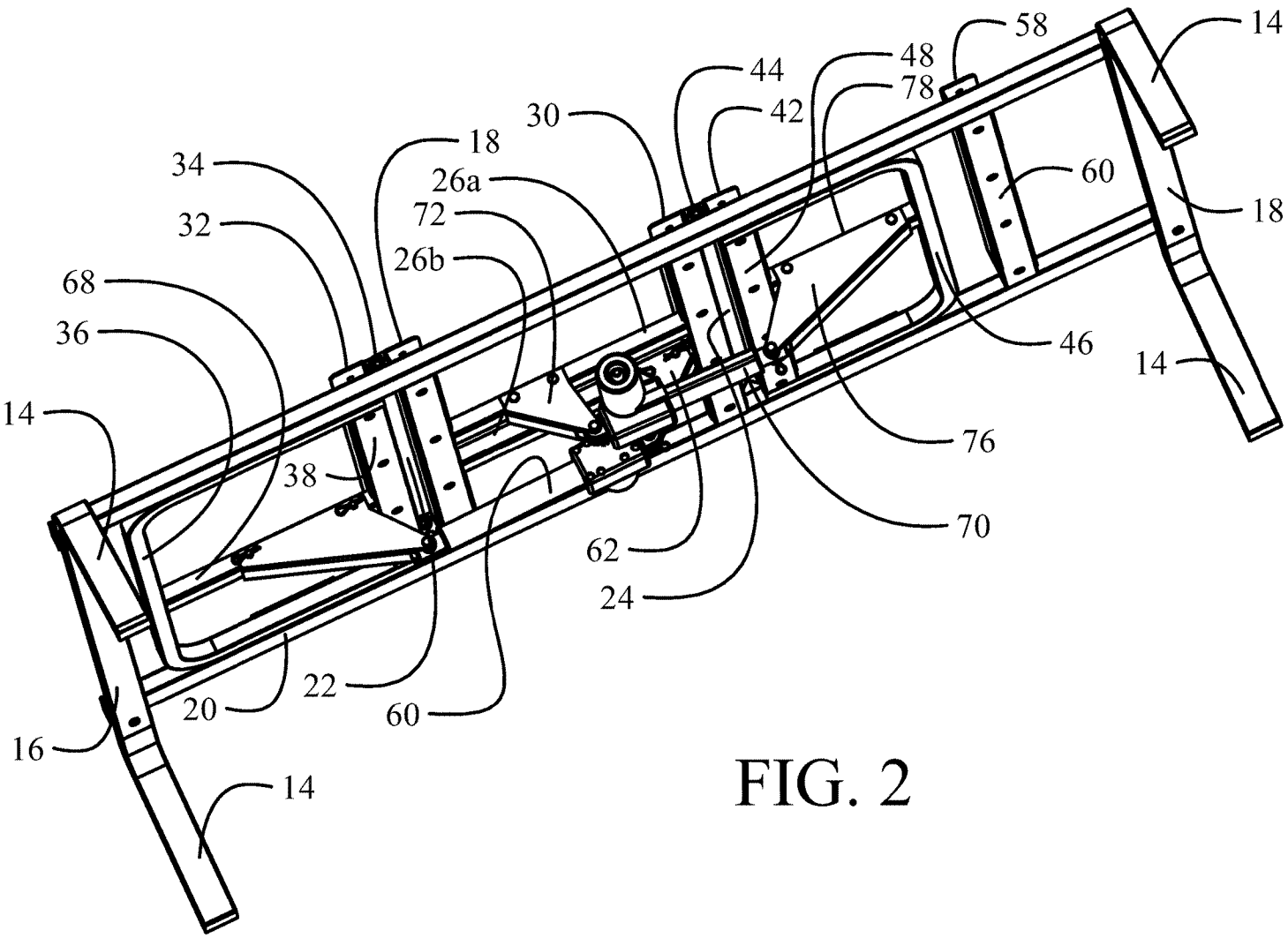
FIG. 2 is a lower pictorial representation of the embodiment as shown in FIG. 1.

Embodiments shown in the drawings and described herein provide an articulating bed which is easily disassembly into components which are easily packed and shipped. Referring to the drawings, FIGS. 1 and 2 show the adjustable bed system 10 which incorporates a frame 12 which is supported by removable legs 14 which are engaged by head frame cross member 16 and foot frame cross member 18. The frame employs side members 20 laterally spaced by a first lateral member 22 and a second lateral member 24 engaged to the side members. Longitudinal members 26*a* and 26*b* extend between the first and second lateral members 22, 24. The frame members as shown in the drawings may be fabricated from steel or aluminum hollow rectangular beams or open channel as will be described in greater detail subsequently.

A first fixed channel 28 is attached to or integral with the first lateral member 22 and extends between the frame side members 20. A second fixed channel 30 is attached to or integral with the second lateral member 24 and extends between the frame side members 20. The first channel is open toward the foot of the bed while the second fixed channel is open toward the head of the bed to receive a seat panel there between as will be described in greater detail subsequently. An upper body articulating assembly 31 (best seen in the articulated position of FIGS. 3 and 4) includes a first rotatable channel 32 engaged to the first fixed channel 28 with hinges 34 (seen in detail in FIG. 8). The first rotatable channel 32 is open toward the head of the bed. An upper body panel support frame 36 extends from the first rotatable channel 32 coplanar with a lower flange 38 of the channel 32 to support an upper body panel. Similarly, a thigh articulating assembly 40 (also best seen in the articulated position of FIGS. 3 and 4) includes a rotatable channel 42 engaged to the second fixed channel 30 with hinges 44. The second rotatable channel is open toward the foot of the bed. A thigh panel support frame 46 extends from the rotatable channel 42 coplanar with a lower flange 48 of the channel 42 to support a thigh panel.

Figure 3:
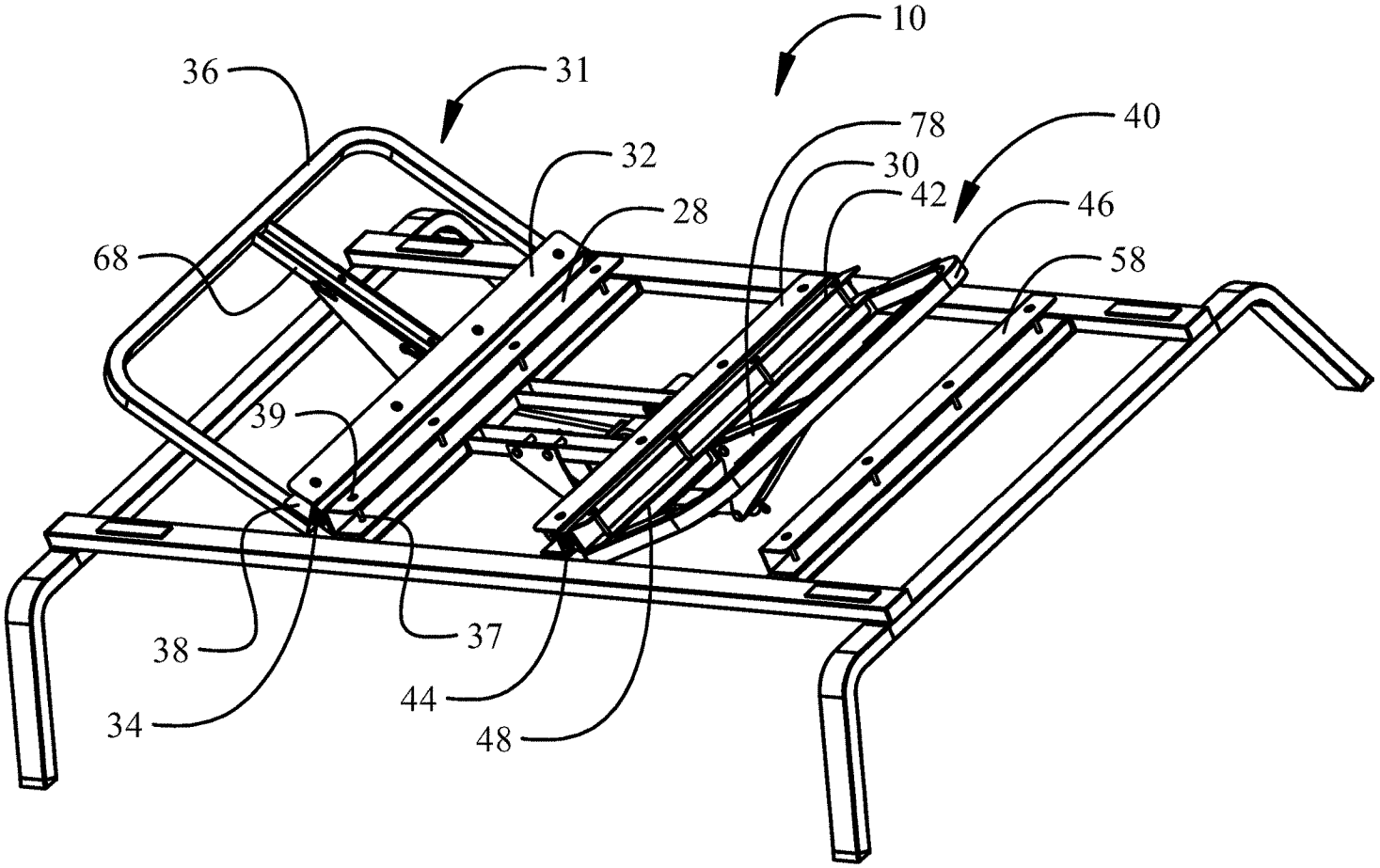
FIG. 3 is an upper pictorial representation of the embodiment with the articulation assembly elevated.
Figure 4:
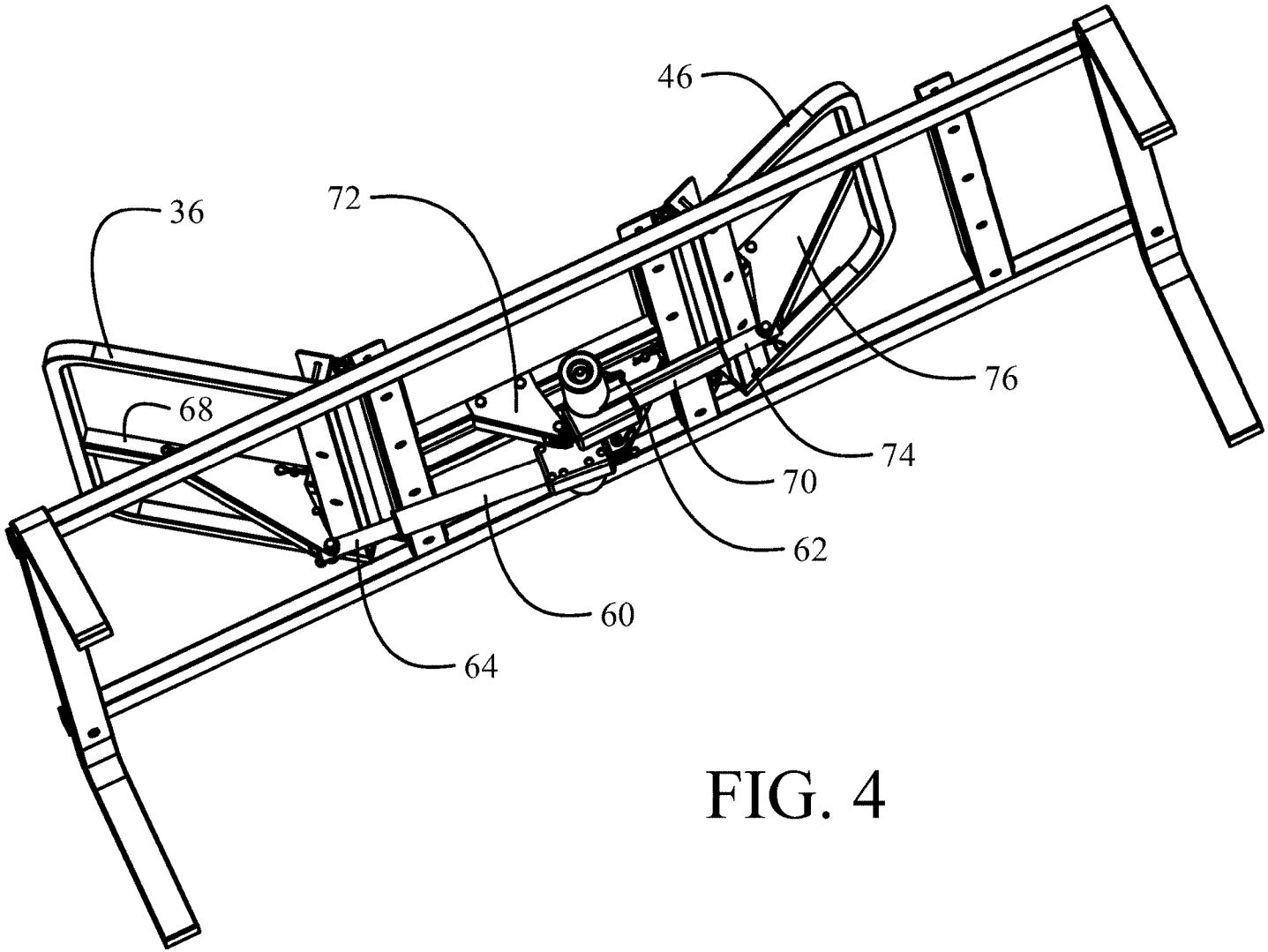
FIG. 4 is a lower pictorial representation of the embodiment as shown in FIG. 3.
Figure 5:
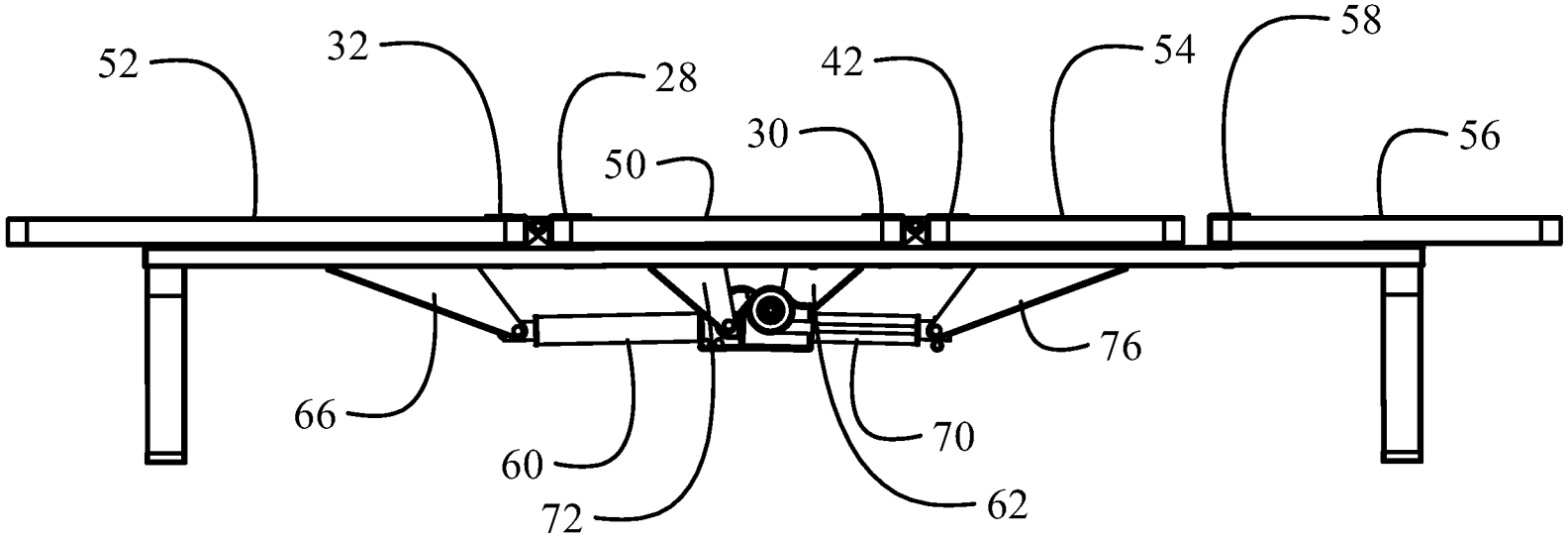
FIG. 5 is a side view of the adjustable bed system with the panel elements installed and in the unarticulated position.
Figure 6:
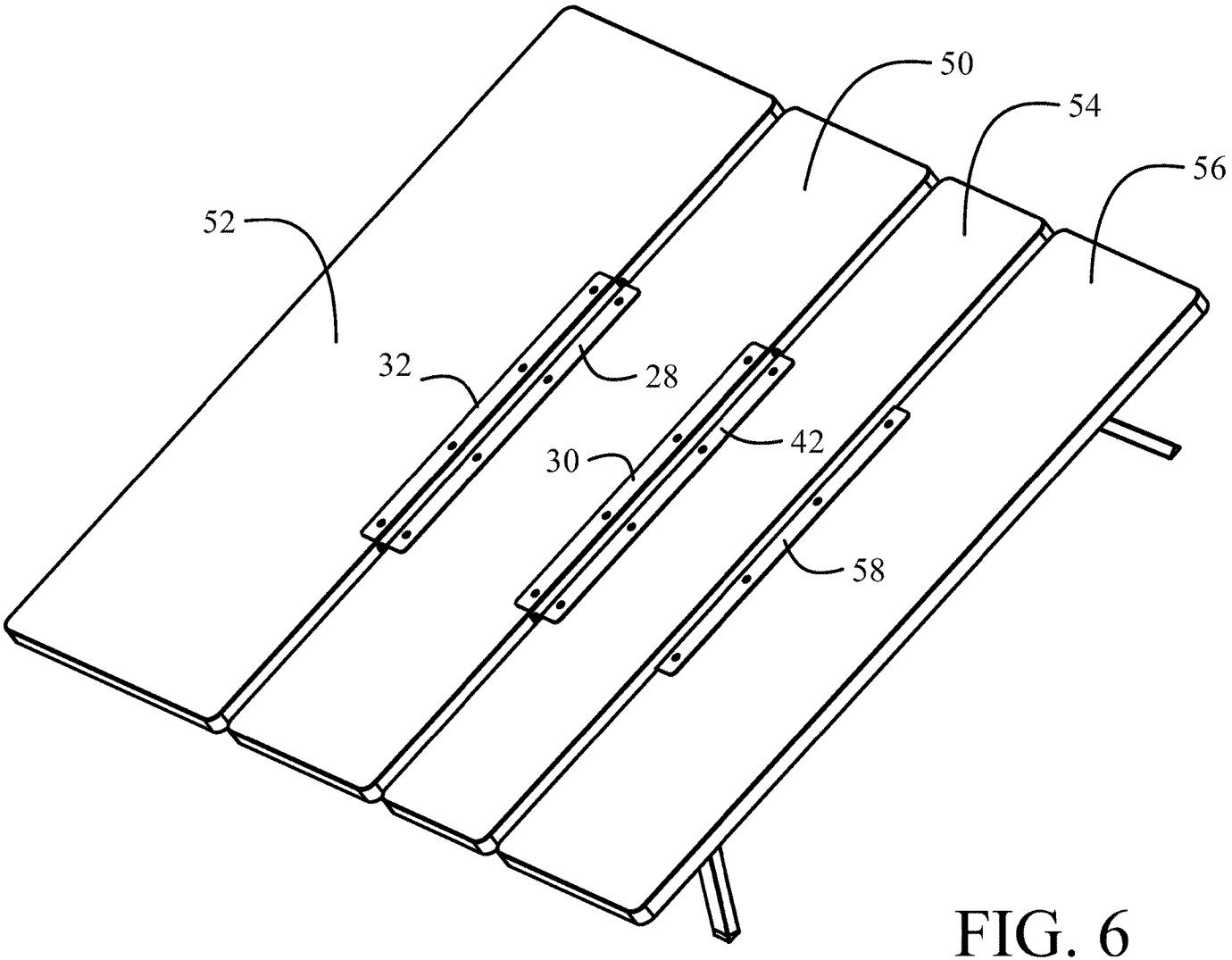
FIG. 6 is an upper pictorial representation of the adjustable bed system with the panel elements installed.

As seen in FIGS. 5 and 6, panels formed of foam or honeycomb core (or blow molded plastic) with laminate facing are employed to provide rigid support panels for mattress support on the fixed and articulating assemblies in the bed. A seat support panel 50 is engaged between the first fixed channel 28 and second fixed channel 30. For the embodiment shown the seat panel 50 may be inserted laterally into the first and second fixed channels. An upper body support panel 52 is engaged in the first rotatable channel 34 and is supported by the upper body panel support frame 36 for articulation as shown in FIG. 3. A thigh support panel 54 is engaged in the second rotatable channel 42 and is supported by the thigh panel support frame 46. The panels are constrained in the open channels with fasteners 37 inserted through bores 39 in the channels as best seen in FIGS. 1 and 3. The fasteners 37 may be received through aligned bores in the panels for rapid assembly and disassembly. The compact nature of the disassembled adjustable bed system is enhanced by the ability of the laminated panels to provide an overhang of up to 50% (25% on each side) over the side members 20 of the frame with no less than 30% for desired compact shipping of the frame. In an exemplary embodiment, the frame is 30 inches wide, the panel width for a Queen mattress size is 60 inches, leaving an overhang of 50%. The frame will support double or twin bed sizes with the same 30 inch frame and smaller panel widths. Upon removal of (or prior to assembly of) the panels the lateral dimension of the articulating system and frame is significantly reduced to allow compact packing of the system for shipment.

For a first embodiment, a fixed foot panel 56 is engaged by a third fixed channel 58 which is secured to a third lateral member 60 extending between side members 20 as seen in FIGS. 1 and 2. The fixed foot panel 56 is shown in FIGS. 5 and 6.

Actuation of the articulating assemblies is accomplished with linear actuators. A first actuator 60 is supported by a removable bracket 62 engaged to the longitudinal member 26*b*. An operating rod 64 (best seen in FIG. 4) is attached to a removable head bracket 66 which is removably attached to a upper body center support 68 substantially centrally engaged in the upper body panel support frame 36. Similarly, a second actuator 70 is supported by a second removable bracket 72 engaged to the longitudinal member 26*a*. An operating rod 74 (best seen in FIG. 4) is attached to a removable foot bracket 76 which is removably attached to a thigh center support 78 substantially centrally located in the thigh panel support frame 42. Actuation of the operating rods 64, 74 elevates the upper body panel support frame 36 and thigh panel support frame 42 for articulation of the bed as desired.

Figure 7:
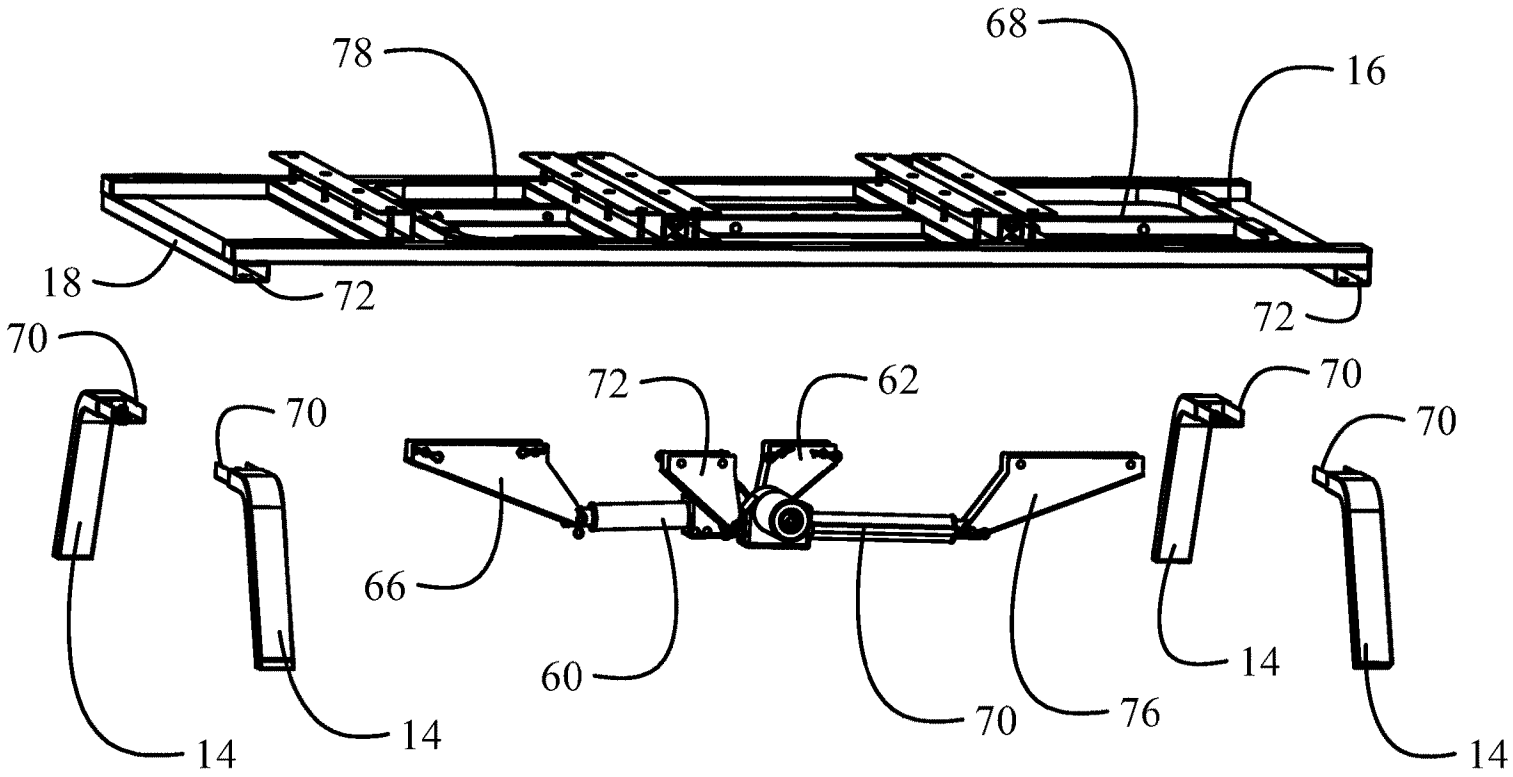
FIG. 7 is an exploded pictorial view of the bed with legs and actuators disassembled for shipment.
Figure 8:
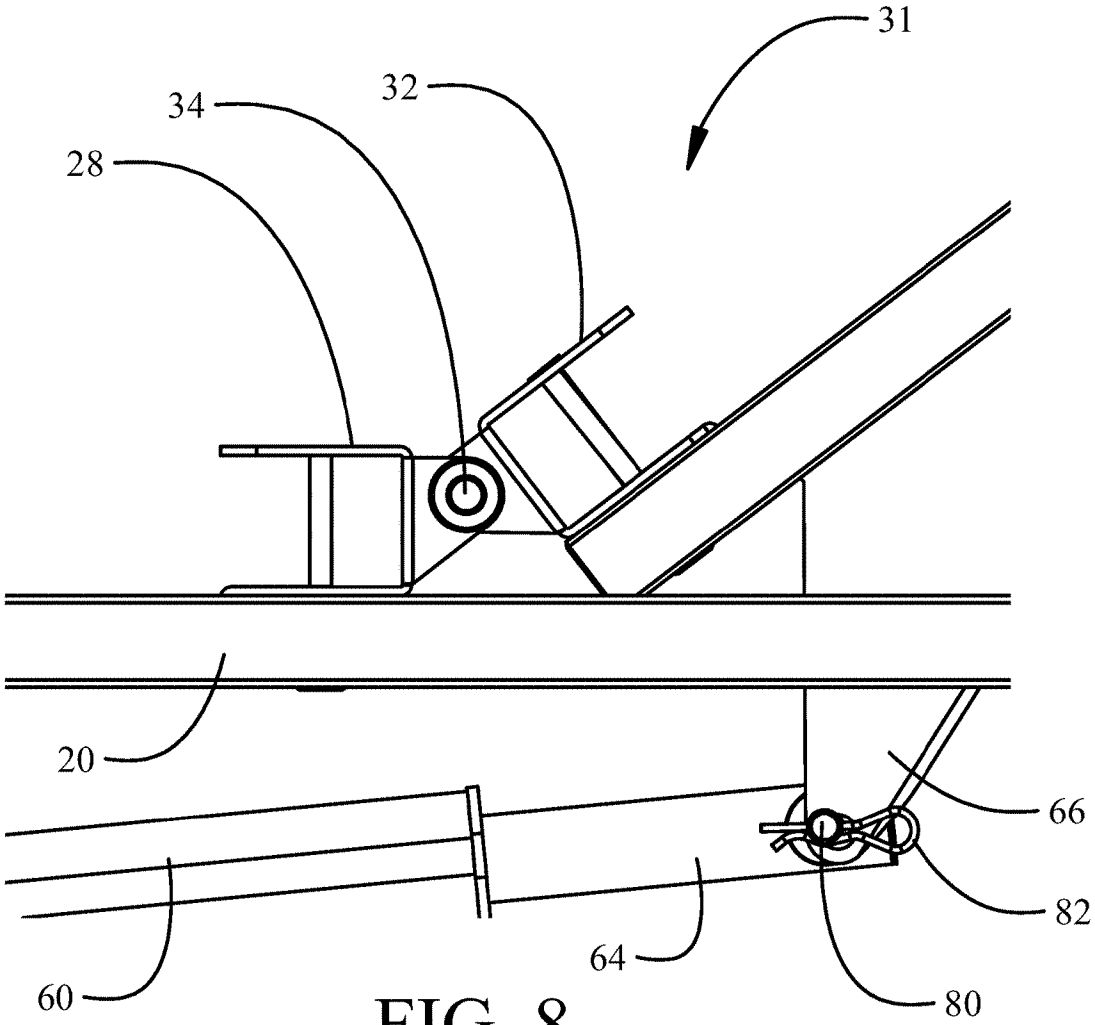
FIG. 8 is a detailed view of the hinges interconnecting the fixed and rotating channels; and, FIG. 9 is an upper pictorial representation of a second embodiment of the adjustable bed system in a partially articulated position.

The structure of the adjustable bed system specifically provides for ease of assembly and disassembly into components which may be easily packaged for shipment. As seen in FIG. 7, the legs 14 are attached to the head and foot frame cross members 16, 18 with joint components 71 telescopically received in the open cavities 70 of the rectangular beam structures of the heat and foot frame members and legs. The removable actuator brackets 62, 66, 72 and 76 allow the actuators 60, 60 to be removed from the associated frame members leaving a substantially flat frame with the panel attachment channels fixed thereto. Connection studs 80 with cotter pins 82, best seen in FIG. 8, are employed to attach the actuator brackets 62, 66, 72 and 76 to the frame members and actuator rods. Removal of the cotter pins allows easy removal of the connection studs and disassembly of the associated brackets and actuators for shipment. This provides a very convenient packaging size for the frame. Fabrication of the frame from steel or aluminum hollow rectangular beams or channel, as previously described, makes the frame and articulating assemblies very light weight.

As also seen in FIG. 8, the hinges 34 engaging the first fixed channel 28 and first rotating channel 32 (and identical hinges 44 for the second fixed channel 30 and second rotating channel 42) are fabricated by stamping. Preferably these hinges will be stamped using rivets as fasteners for efficient assembly. However, the hinges could easily be assembled with bolt washer and nut providing a rugged yet simple and reliable engagement for rotation of the upper body articulation system 31 and thigh articulation system 40.

Figure 9:
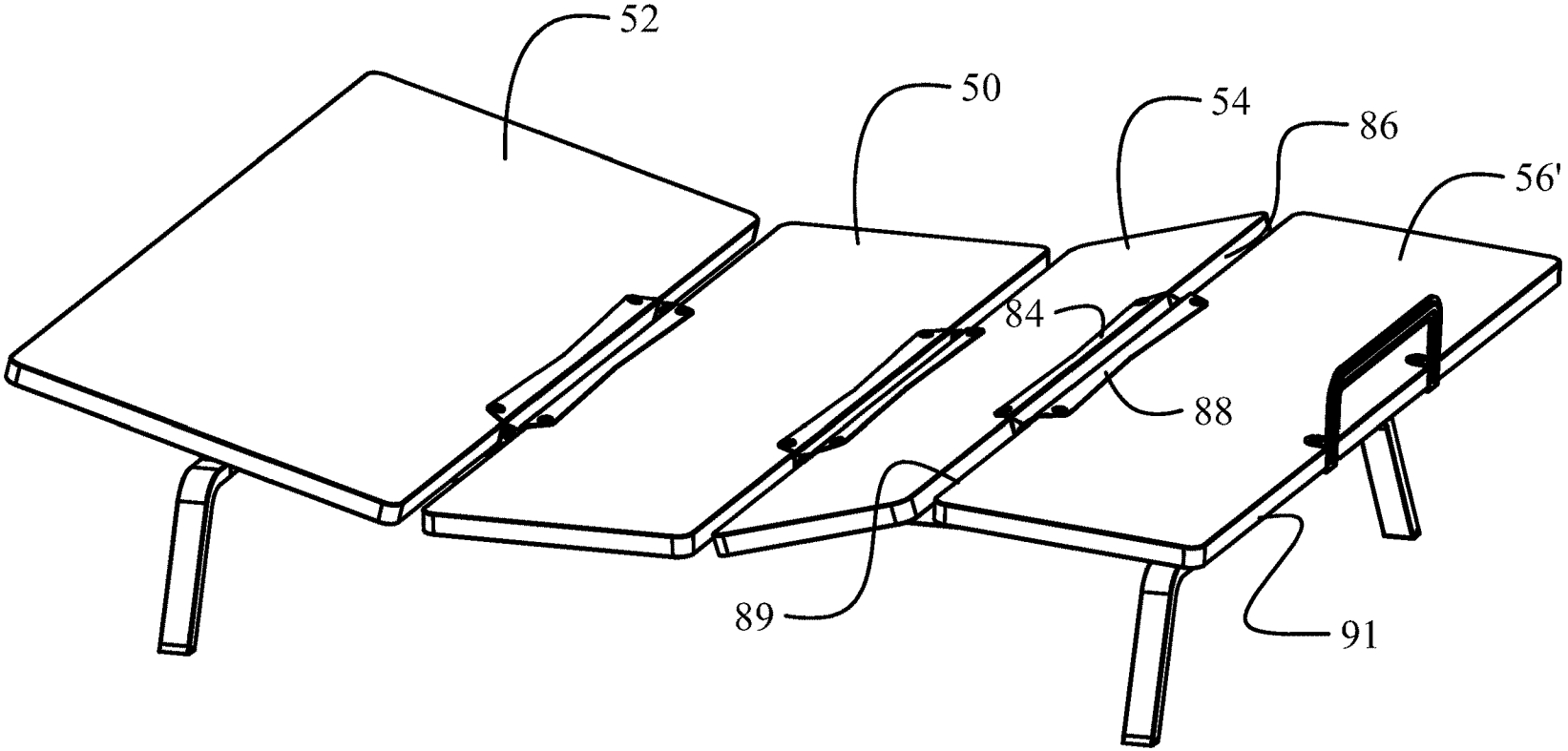
Figure 10:
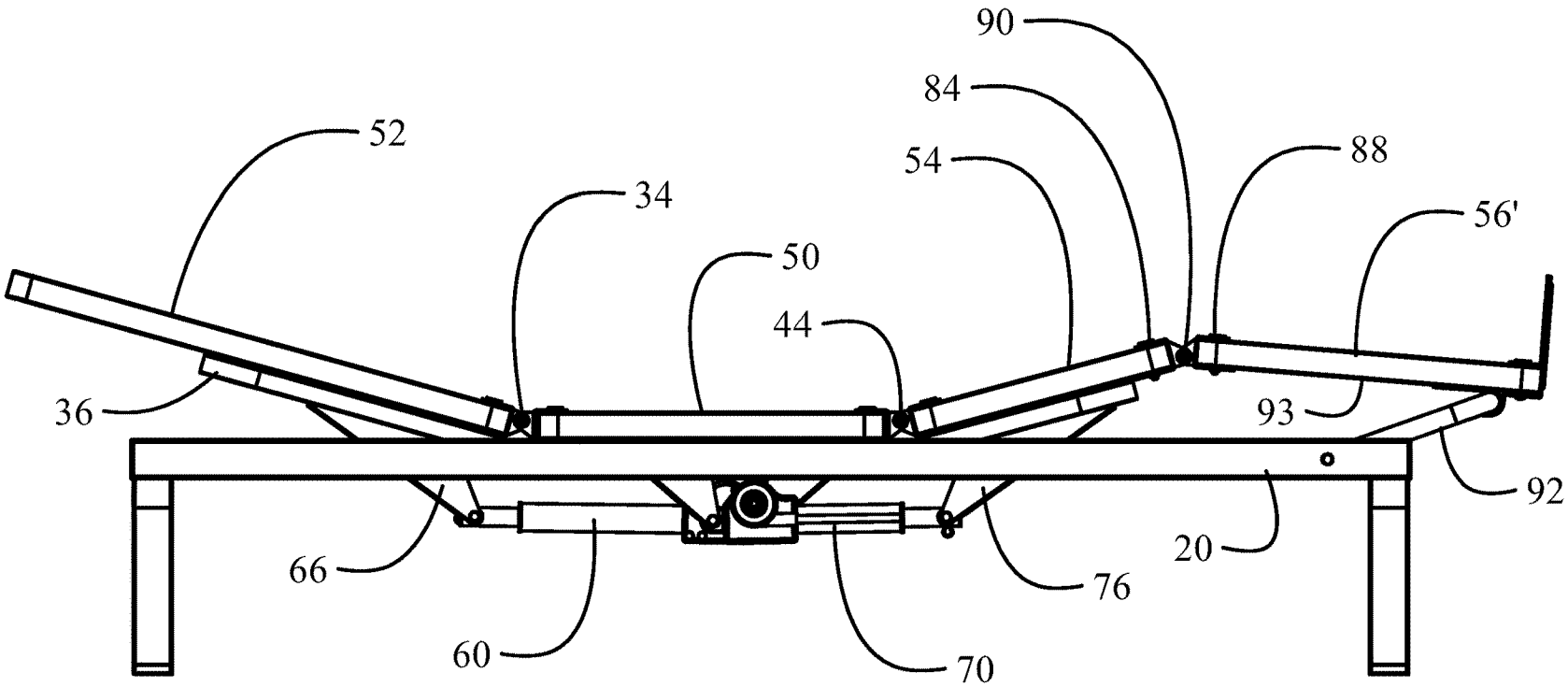
FIG. 10 is a side view of the embodiment of FIG. 9.
Figure 11:
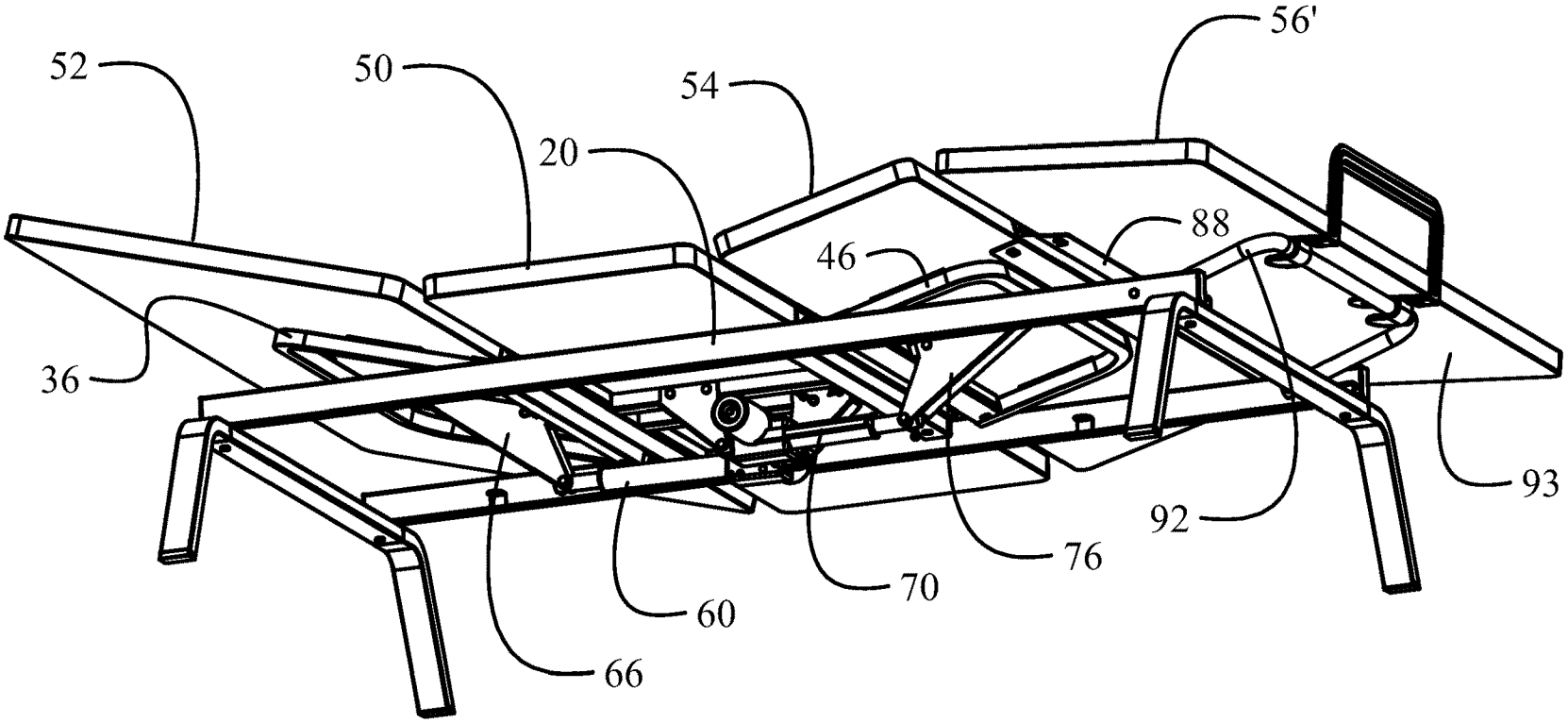
FIG. 11 is a lower pictorial representation of the second embodiment of FIG. 9.

A second embodiment disclosed in FIGS. 9, 10 and 11 provides a traditional elevating foot panel 56' attached to the thigh support panel 54. A first interconnecting open channel 84 is removably attached to a foot end 86 of the thigh support panel 54. A second interconnecting open channel 88, removably attached to a head end 89 of foot panel 56', is connected to the first interconnecting open channel with third hinges 90. With this attachment the head end of the foot panel is elevated with the thigh panel upon elevation of the thigh articulation system 40. Relative movement of a foot end 91 of the foot panel 56' is controlled with a rotating support 92 rotatably engaged to the side members 20 of the frame and a lower surface 93 of the foot panel proximate the foot end 91. Displacement of the head end of the foot panel toward the head of the bed during rotation of the thigh panel engages the rotating support 92 in compression which rotates the support thereby elevating the foot end of the foot panel. Operation of the upper body support articulation system using upper body support frame 36 and actuator 60 and the thigh support articulation system using thigh support frame 46 and actuator 70 are as previously described. Disassembly of the lower leg support panel 56' for shipment is accomplished by removing the first and second interconnecting open channels 84, 88 from the thigh support panel 54 and foot panel 56'.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. An articulating bed assembly comprising:

a frame having side frame members;

a first rotatable channel extending laterally between the side frame members and rotatable with first hinges, the first rotatable channel open toward a head of the articulating bed assembly;

an upper body support panel removably engaged in the first rotatable channel;

an upper body panel support frame extending from the first rotatable channel coplanar with a lower flange of the first rotatable channel to support the upper body support panel;

a second rotatable channel extending laterally between the side frame members and rotatable with second hinges, the second rotatable channel open toward a foot of the articulating bed assembly; and, a thigh support panel removably engaged in the second rotatable channel;

a thigh panel support frame extending from the second rotatable channel coplanar with a lower flange of the second rotatable channel to support the thigh support panel.

2. The articulating bed as defined in claim 1 further comprising:

a first fixed channel extending laterally between the frame side members, said first hinges engaged between the first rotatable channel and first fixed channel;

a second fixed channel extending laterally between the frame side members, said second hinges engaged between the second rotatable channel and second fixed channel; and, a seat panel removably engaged between the first fixed channel and second fixed channel.

3. The articulating bed as defined in claim 2 further comprising a first actuator removably interconnected between the frame and the upper body panel support frame, operation of the first actuator articulating the upper body panel support frame.

4. The articulating bed as defined in claim 3 further comprising a second actuator removably interconnected between the frame and thigh panel support frame, operation of the second actuator articulating the thigh panel support frame.

5. The articulating bed as defined in claim 3 further comprising a first longitudinal member extending between the first fixed channel and second fixed channel, said first actuator removably connected to the first longitudinal member with a removable first bracket.

6. The articulating bed as defined in claim 5 further comprising:

an upper body center support substantially centrally engaged in the upper body panel support frame; and, a head bracket removably attached to the upper body center support and removably attached to an operating rod of the first actuator.

7. The articulating bed as defined in claim 4 further comprising a second longitudinal member extending between the first fixed channel and second fixed channel, said second actuator removably connected to the second longitudinal member with a removable second bracket.

8. The articulating bed as defined in claim 7 further comprising:

a thigh center support substantially centrally engaged in the thigh panel support frame; and, a foot bracket removably attached to the thigh center support and removably attached to an operating rod of the second actuator.

9. The articulating bed as defined in claim 2 further comprising:

a third fixed channel extending laterally between the frame side members; and, a foot panel removably engaged in the third fixed channel.

10. The articulating bed as defined in claim 2 further comprising:

a first interconnecting open channel removably attached to a foot end of the thigh support panel;

a second interconnecting open channel, removably attached to a head end of a foot panel and connected to the first interconnecting open channel with third hinges, whereby upon the foot panel is elevated with the thigh support panel.

11. The articulating bed as defined in claim 10 further comprising:

a rotating support rotatably engaged to the side frame members and a lower surface of the foot panel proximate a foot end of the foot panel.

12. The articulating bed as defined in claim 6 wherein the first bracket is connected to the first longitudinal frame member and the first actuator, and the head bracket is connected to the upper body center support and operating rod of the first actuator with connection studs and cotter pins.

13. The articulating bed as defined in claim 8 wherein the second bracket is connected to the second longitudinal frame member and the second actuator, and the foot bracket is connected to the thigh center support and operating rod of the second actuator with connection studs and cotter pins.

14. The articulating bed as defined in claim 2 wherein the upper body support panel, thigh support panel and seat panel are constrained in the first rotatable channel, second rotatable channel and fixed channels with fasteners inserted through bores in the channels and received through aligned bores in the panels for rapid assembly and disassembly.

15. The articulating bed as defined in claim 2 wherein the upper body support panel, thigh support panel and seat panel have an overhang of 25% to 50% of total width over the side members of the frame.

* * * * *